US007210877B2

(12) United States Patent
Jensen et al.

(10) Patent No.: US 7,210,877 B2
(45) Date of Patent: May 1, 2007

(54) EROSION CONTROL DEVICE AND MATRIX

(76) Inventors: John S. Jensen, 4651 Mill Pond Rd., Myrtle Beach, SC (US) 29579; John Eric Jensen, 13811 Valleybrooke La., Orlando, FL (US) 32826

( * ) Notice: Subject to any disclaimer, the term of this patent is extended or adjusted under 35 U.S.C. 154(b) by 0 days.

(21) Appl. No.: 10/980,667

(22) Filed: Nov. 3, 2004

(65) Prior Publication Data

US 2006/0093434 A1 May 4, 2006

(51) Int. Cl.
*E02B 3/14* (2006.01)

(52) U.S. Cl. ..... 405/16

(58) Field of Classification Search ..... 405/15–18, 405/21, 73, 19, 20, 302.4, 302.6; 404/6, 404/9, 12–13

See application file for complete search history.

(56) References Cited

U.S. PATENT DOCUMENTS

| | | | | |
|---|---|---|---|---|
| 132,801 | A | 11/1872 | Chinnock | |
| 649,323 | A | 5/1900 | Litz | |
| 746,094 | A | 12/1903 | Judson | |
| 817,282 | A * | 4/1906 | Stewart | 256/35 |
| 1,066,092 | A | 7/1913 | Ellery | |
| 1,412,504 | A | 4/1922 | Byrne | |
| 2,454,292 | A | 11/1948 | Pickett | |
| 2,876,628 | A | 3/1959 | Dixon, Jr. | |
| 3,252,287 | A | 5/1966 | Suzuki | |
| 3,344,609 | A | 10/1967 | Greiser | |
| 4,152,875 | A | 5/1979 | Soland | |
| 4,372,705 | A | 2/1983 | Atkinson | |
| 4,436,447 | A | 3/1984 | Crowe | |
| 4,572,705 | A | 2/1986 | Vignon et al. | |
| 4,629,358 | A | 12/1986 | Springston et al. | |
| 4,664,552 | A | 5/1987 | Schaaf | |
| 4,694,629 | A | 9/1987 | Azimi | |
| 4,828,425 | A * | 5/1989 | Duckett | 404/6 |
| 5,046,884 | A * | 9/1991 | Girotti | 404/6 |
| 5,074,704 | A * | 12/1991 | McKay | 404/6 |
| 5,160,215 | A | 11/1992 | Jensen | |
| 5,443,324 | A * | 8/1995 | Sullivan | 404/6 |
| 5,605,413 | A * | 2/1997 | Brown | 404/6 |
| 6,203,242 | B1 * | 3/2001 | Englund | 404/6 |
| 6,840,706 | B1 * | 1/2005 | Camomilla et al. | 404/6 |
| 2005/0135878 | A1 * | 6/2005 | McNally et al. | 404/6 |

FOREIGN PATENT DOCUMENTS

| | | | |
|---|---|---|---|
| DE | 2011246 | | 9/1970 |
| FR | 518239 | | 5/1921 |
| JP | 5-171650 | * | 7/1993 |

* cited by examiner

*Primary Examiner*—Sunil Singh
(74) *Attorney, Agent, or Firm*—Harleston Law Firm LLC

(57) ABSTRACT

An erosion control device for use on beach and land areas subject to erosion includes: (a) an elongated beam portion comprising a first wall and a first base; (b) a cross-beam portion having a length that is less than half the length of the elongated beam portion, the cross-beam portion including a second wall and a second base; and (c) a mechanism for connecting the device to a second erosion control device; wherein the cross-beam portion extends transversely through the elongated beam portion at about a mid-point of the elongated beam portion. Also included herein is a matrix of interconnectable, relatively uniform erosion control devices.

10 Claims, 13 Drawing Sheets

EROSION CONTROL DEVICE AND MATRIX

BACKGROUND OF THE INVENTION

1. Technical Field

The present invention relates to a erosion control device for stabilizing soils and remedying beach and land erosion, a number of which can be assembled into a matrix for laying on or just below the surface of the ground or beach.

2. Background Information

Beach erosion and shore building are natural processes caused by the impact over time of waves on the shore. Waves breaking on the beach carry sedimentary material, also called littoral drift, onshore as the waves ascend the beach, and offshore as the waves retreat back. Waves arrive at an angle to the shore and retreat generally perpendicularly to the shore, resulting in a long shore current. This carries the littoral drift in a series of zigzags along the shoreline. The amount of littoral drift is dependent upon the speed of the waves; faster wave action translates to a higher amount of littoral drift. Littoral drift is deposited when the current (i.e., speed of the waves) slows. Thus, waves "steal" from one part of the beach to "feed" another part of the beach. During high tides, waves deposit sediment on higher areas of the beach while current close to the shoreline wears away at lower-lying areas of the beach. In the unusual event of an earthquake, enormous waves can be created that displace large amounts of sedimentary material.

The coast has some natural defenses against erosion. Gently sloping shores dissipate the energy of breaking waves, which decreases their speed as well as the amount of littoral drift. Dunes are natural seawalls, especially when they are covered with vegetation, which binds the sand. Inlets and bays are less subject to severe wave action and turbulence.

However, beach erosion and shore building are frequently accelerated by human activities. Heavy use and over development in shore areas, for example, hastens the erosion process. Damaging activities include dredging for marinas, bulldozing dunes, and pedestrian and vehicular traffic. Bulldozing dunes removes an important coastal defense, since dunes are natural seawalls. Pedestrian and vehicular traffic destroys vegetation and weakens bluffs and banks making them more susceptible to erosion. Obviously, removing large quantities of sand and sediment from a shore area without replacing it accelerates erosion.

Billions of dollars are spent each year on beach re-nourishment projects all along the coasts of the United States. Sand is brought in and spread on existing beaches in an effort to re-nourish them. Wide, attractive beaches in tourist-drawing seaside communities bring in more tourist dollars. Also, wide beaches are said to protect adjacent developed coastal areas from hurricane damage. In some areas where erosion is causing building structures to be washed away, re-nourishment is preventing loss of real estate every year. Beach re-nourishment, or replenishment, projects are controversial, though, because they are said to disrupt natural rhythms and cause more harm in the long run. Imported sand or sand pumped in from off shore dredges usually erodes away from the replenished beach at a faster rate.

Many man-made defenses against erosion, such as breakwaters, jetties, groins, seawalls, sand trapping devices, grass planting, and sand fences, also exist. However, such defenses have disadvantages. For example, breakwaters prevent wave erosion, but not longshore drifts, and are expensive. Seawalls deflect wave energy, but are very expensive and often utilized as a last resort because inevitably the sea slowly destroys sea walls. In fact, poorly designed or improperly installed erosion devices can actually accelerate erosion.

In sum, erosion is generally unstoppable. Yet people still flock to the seashore to build homes, hotels, and other structures directly in the path of erosion. Coastal residents continue to pay a high price, as erosion incessantly damages and claims their property. Thus, there is a need for an inexpensive erosion control device that works.

BRIEF SUMMARY OF THE INVENTION

The present invention is an erosion control device for stabilizing soil and remedying beach and soil erosion, which includes:

(a) an elongated beam portion comprising a first wall and a first base;

(b) a cross-beam portion having a length that is less than half the length of the elongated beam portion, the cross-beam portion comprising a second wall and a second base; and (c) a mechanism for connecting the erosion control device to a second erosion control device;

wherein the cross-beam portion extends transversely through the elongated beam portion at about a mid-point of the elongated beam portion. Also included herein is an erosion control matrix comprising at least two erosion control devices, each erosion control device comprising:

(a) an elongated beam portion comprising a first wall and a first base; and (b) a cross-beam portion having a length that is less than half the length of the elongated beam portion, the cross-beam portion extending transversely through the elongated beam portion at about a mid-point of the elongated beam portion, the cross-beam portion comprising a second wall and a second base;

wherein the cross beam portion and the elongated beam portion each comprise opposite end walls, each end wall comprising a semi-circular channel; and wherein the two erosion control devices are detachably connectable end to end, side by side, or end to side.

The interconnectable devices of the present invention both prevent erosion and ameliorate the adverse effects of erosion that has already occurred. They are useful for protecting replenished beaches. They can also be used for stabilizing the ground under or on roadbeds, highway shoulders, embankments, dikes, and roadside ditches and drainage ditches.

Beaches also support a variety of wildlife, whose niches are destroyed as beaches erode over time. Sea turtle populations, for example, are adversely affected by erosion and detrimental human activities as their nesting sites are compromised. For example, all of the species of sea turtles indigenous to Florida, such as loggerhead (*Caretta caretta*) and green sea turtles (*Chelonia mydas*), are considered threatened or endangered. The decline of leatherbacks (*Dermochelys coriacea*), which nest along the Pacific coasts of Mexico, Costa Rica, etc., has also been dramatic. Matrices of larger size erosion control devices according to the present invention help ameliorate this decline in that they help to remedy and prevent erosion, which benefit sea turtle populations. Also, the spaces within the erosion control matrices of the present invention provide nesting sites for nesting sea turtle, with the erosion control devices surrounding the nesting sea turtle providing protection for it.

BRIEF DESCRIPTION OF THE SEVERAL VIEWS OF THE DRAWINGS

A more complete understanding of the invention and its advantages will be apparent from the following detailed description taken in conjunction with the accompanying drawings, wherein examples of the invention are shown, and wherein.

DETAILED DESCRIPTION OF THE INVENTION

Figure 1:
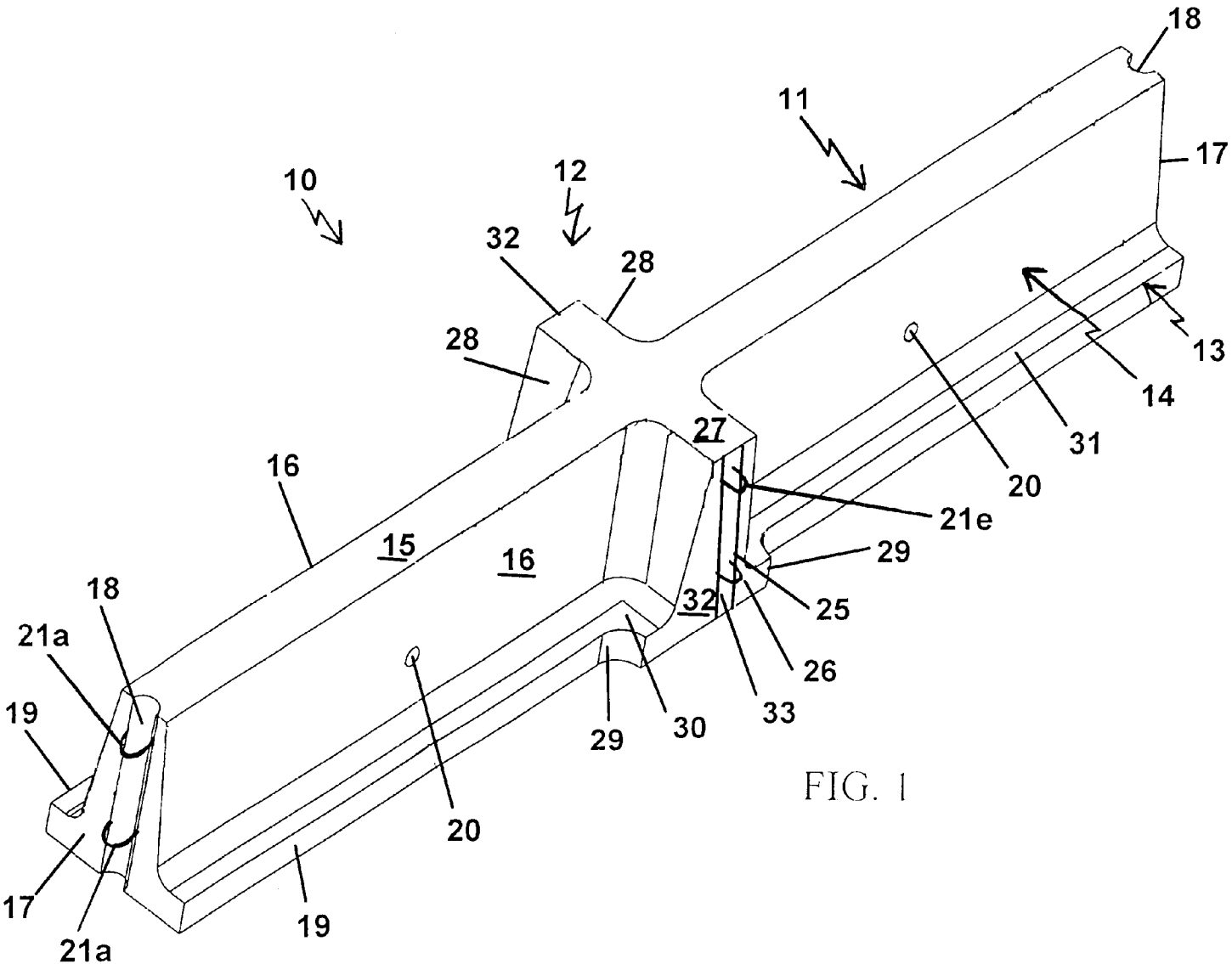
FIG. 1 is a perspective view of an erosion control device according to the present invention.

In the following description, like reference characters designate like or corresponding parts throughout the several views. Also, in the following description, it is to be understood that such terms as "front," "back," "within," and the like are words of convenience and are not to be construed as limiting terms. Referring in more detail to the drawings, the invention will now be described.

Turning first to FIG. 1, a generally I-beam-shaped erosion control device according to the present invention, referred to herein as 10, is comprised of an elongated beam portion 11 and a cross-beam portion 12 that extends transverse to the elongated beam portion. The length of the cross-beam portion 12 is less than half the length of the elongated beam portion 11.

The elongated beam portion 11 is comprised of a first wall 14 supported on a first base 13 (see FIG. 1). The first wall 14 has a generally planar wall top face 15 opposite the first base 13 and substantially perpendicular to two opposed, mirror image, generally planar wall side faces 16. Preferably, the side faces 16 gradually angle outward toward generally planar base side faces 19, making the first wall 14 generally trapezoidal in shape. The first wall 14 sits on the first base 13, which also comprises a generally planar base top face 31 and a generally planar base bottom face (not shown). The base top face 31 and the base bottom face are spaced apart by the base side faces 19 and are substantially parallel to each other. The base side faces 19 are spaced apart by the base top face 31 and the base bottom face and are also substantially parallel to each other. Thus, the first base 13 is generally rectangular in shape. The first base 13 is wider than the first wall 14 so as to impart stability to the erosion control device 10.

With continued attention to FIG. 1, the cross-beam portion 12 is substantially equal in height and width to the elongated beam portion 11. The cross-beam portion 12 extends transversely through the elongated beam portion 11 at approximately the mid-point of the elongated beam portion. The cross-beam portion 12 also includes a second wall 25, which lies on and is supported by a second base 26. The second base 26 is substantially wider than the second wall 25. The second wall 25 has a generally planar second wall top face 27 opposite the second base 26 and substantially perpendicular to two opposed, mirror image, generally planar, second wall side faces 28. Preferably, the second wall side faces 28 gradually angle outward toward planar second base side faces 29, making the second wall 25 generally trapezoidal in shape. The second wall 25 sits on the second base 26, which also comprises a generally planar second base top face 30 and a generally planar second base bottom face (not shown). The second base top face 30 and the second base bottom face are spaced by the second base side faces 29, and are substantially parallel to each other. The second base side faces 29 are spaced apart by the second base top face 30 and the second base bottom face and are also substantially parallel to each other. Thus, the second base 26 is generally rectangular in shape. Again, the second base 26 is wider than the second wall 25 in order to impart stability to the erosion control device 10.

Figure 2:
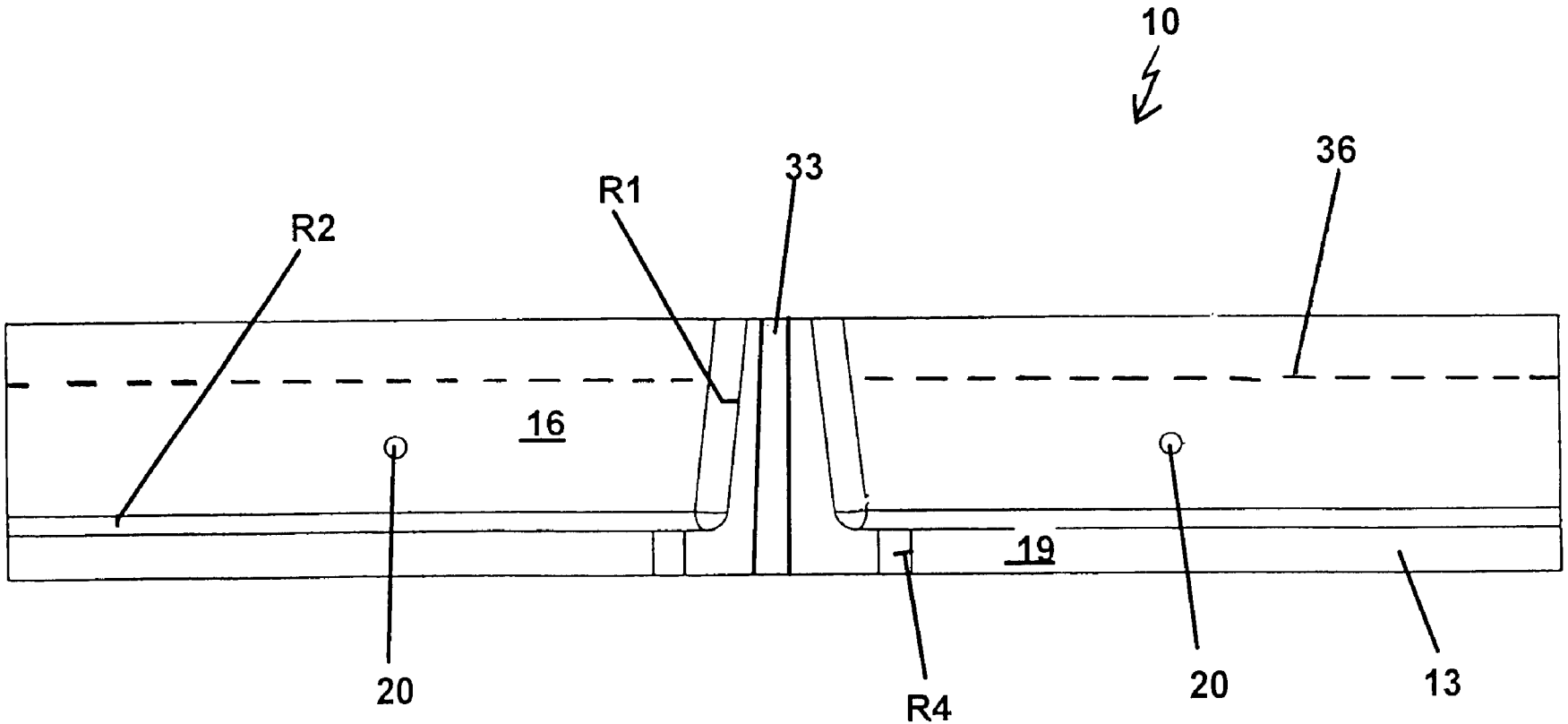
FIG. 2 is a front elevational view of the erosion control device according to FIG. 1.

Turning to FIG. 2, a pair of similarly sized, cross apertures 20 extend transversely through the elongated beam portion 11. The cross apertures 20 are preferably generally circular in shape. In use, each cross aperture 20 receives a cable or chain, which allows tightening of the grid and provides extra strength to the matrix formed by a number of interconnected erosion control devices.

Figure 3:
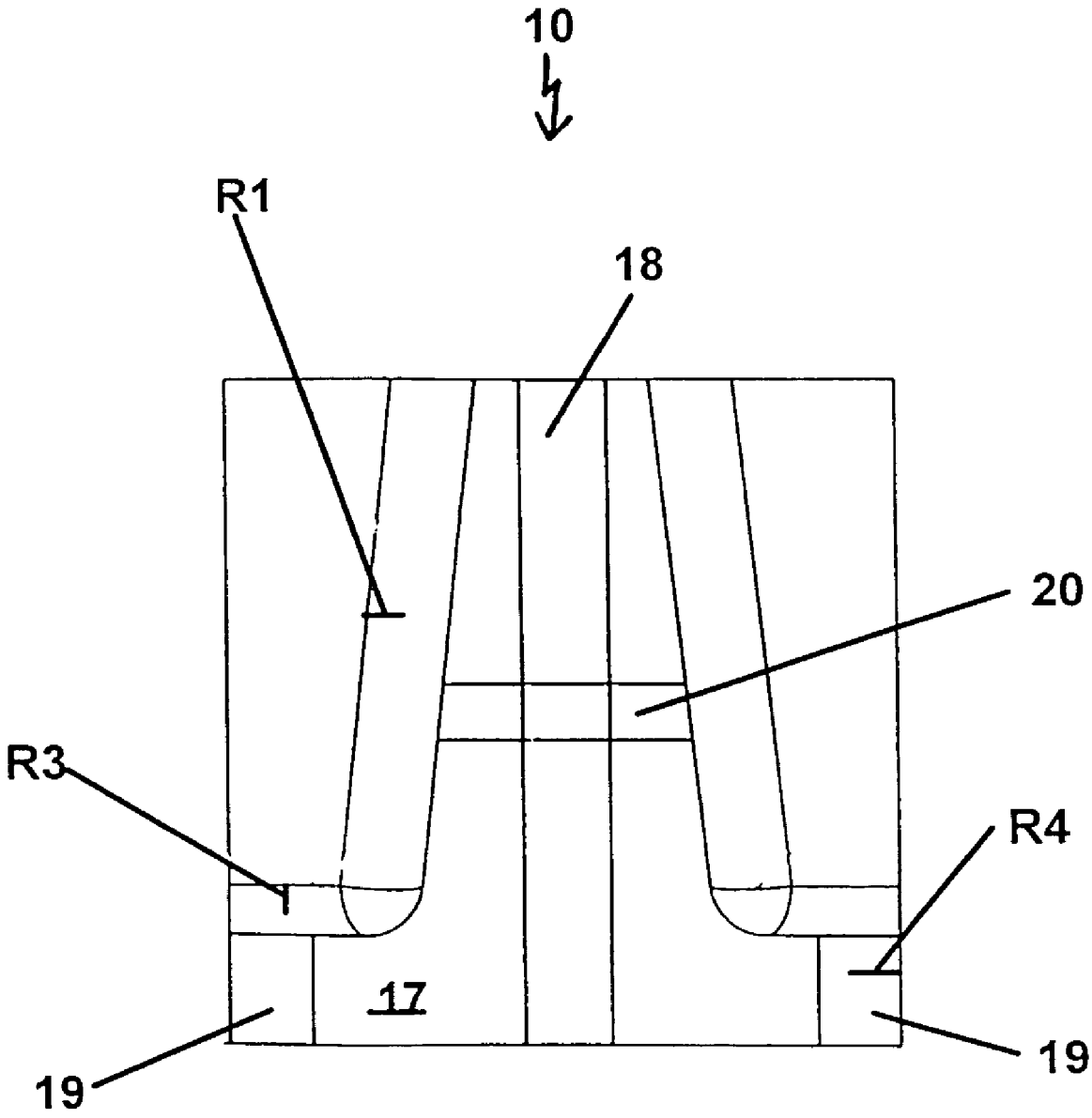
FIG. 3 is a side elevational view of the erosion control device according to FIG. 1.
Figure 4:
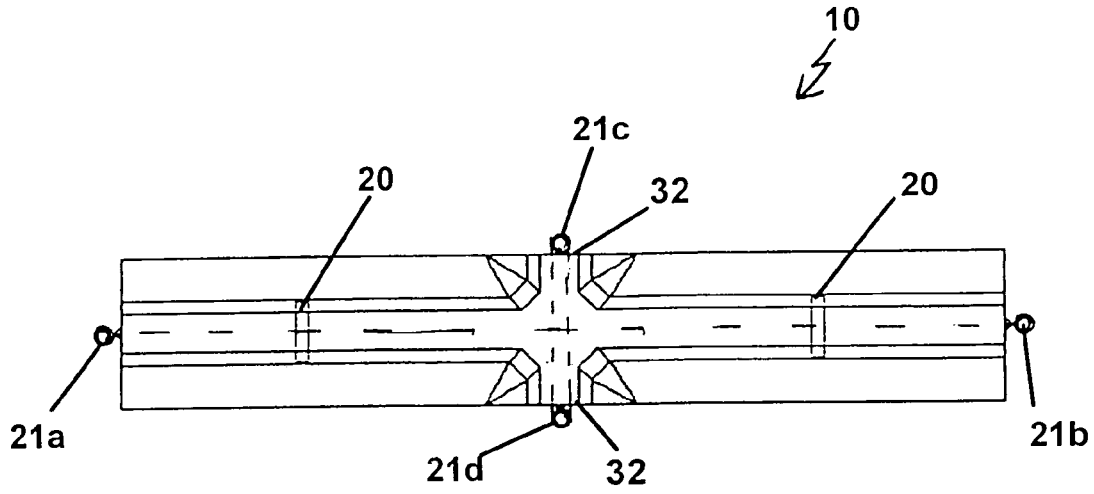
FIG. 4 is a top plan view of an erosion control device according to the present invention, shown with attached eye rings.
Figure 5:
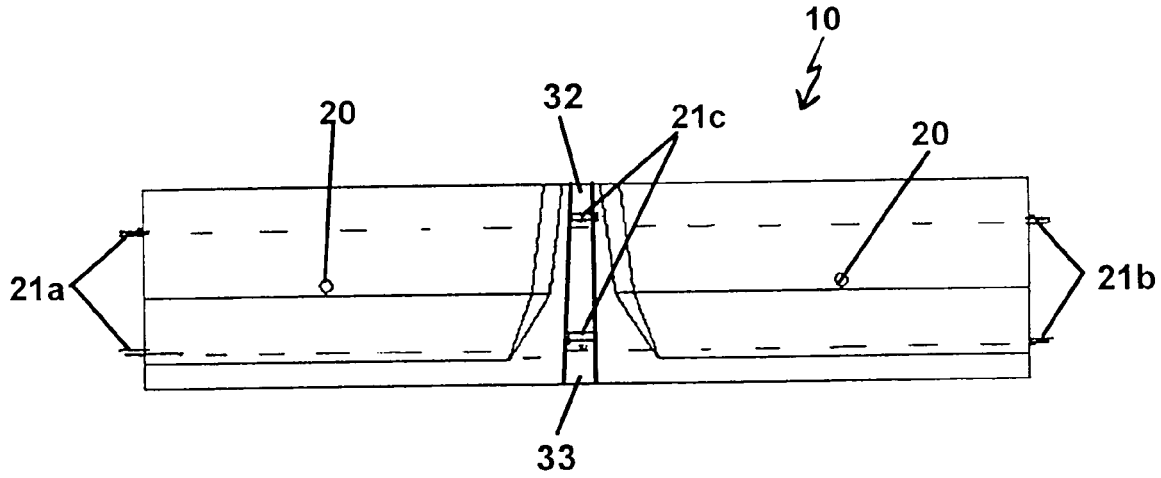
FIG. 5 is a front elevational view of the erosion control device according to FIG. 4.

Referring to FIGS. 3, 4, and 5, the erosion control device 10 includes first end walls 17 at opposite ends of the elongated beam portion 11. Each one includes a first channel 18 that extends from the wall top face 15 to the base bottom face (see FIG. 3). In use, the first channels 18 accommodate attachment pins 34 (see FIG. 8). As shown in FIGS. 4 and 5, pairs of spaced apart, similarly sized end loops 21*a*, 21*b* project from the first end walls 17 and into the first channels 18. Most preferably, the first channels 18 are generally semi-circular in shape, the end loops 21*a*, 21*b* are generally circular in shape, and the radii of the first channels 18 are approximately equal to the outer radii of the end loops 21*a*, 21*b*. The pair of end loops 21*a* is vertically displaced from the pair of end loops 21*b*, so they do not knock into each other when two erosion control devices are joined. The end loops 21*a*, 21*b* are most preferably heavy duty, galvanized I-bolts or U-rings. In use, the end loops 21*a*, 21*b* and the first channels 18 secure a number of erosion devices 10 together end to end, as shown in FIGS. 8 and 9.

Figure 6:
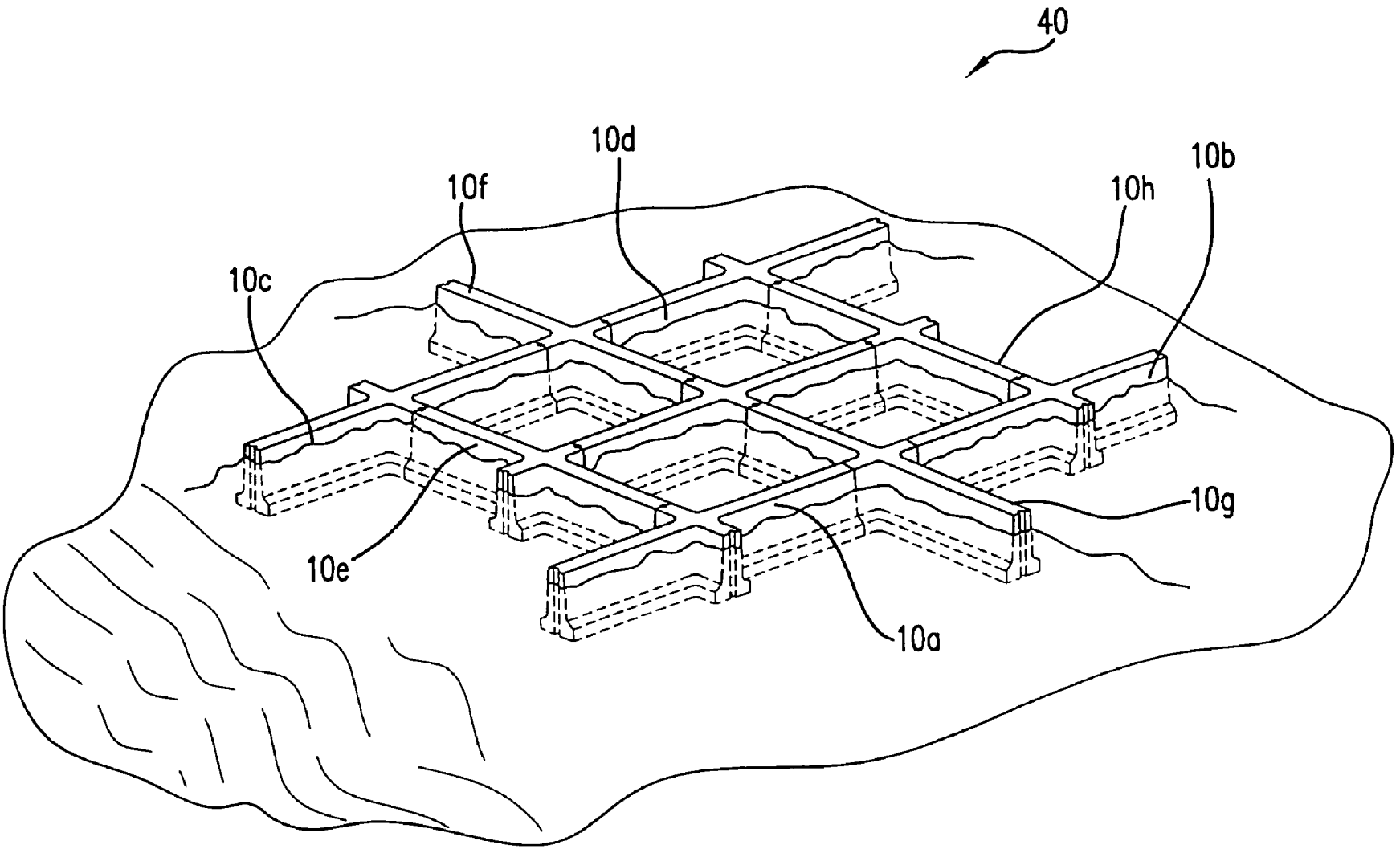
FIG. 6 is a perspective view of an erosion control matrix according to the present invention.
Figure 7:
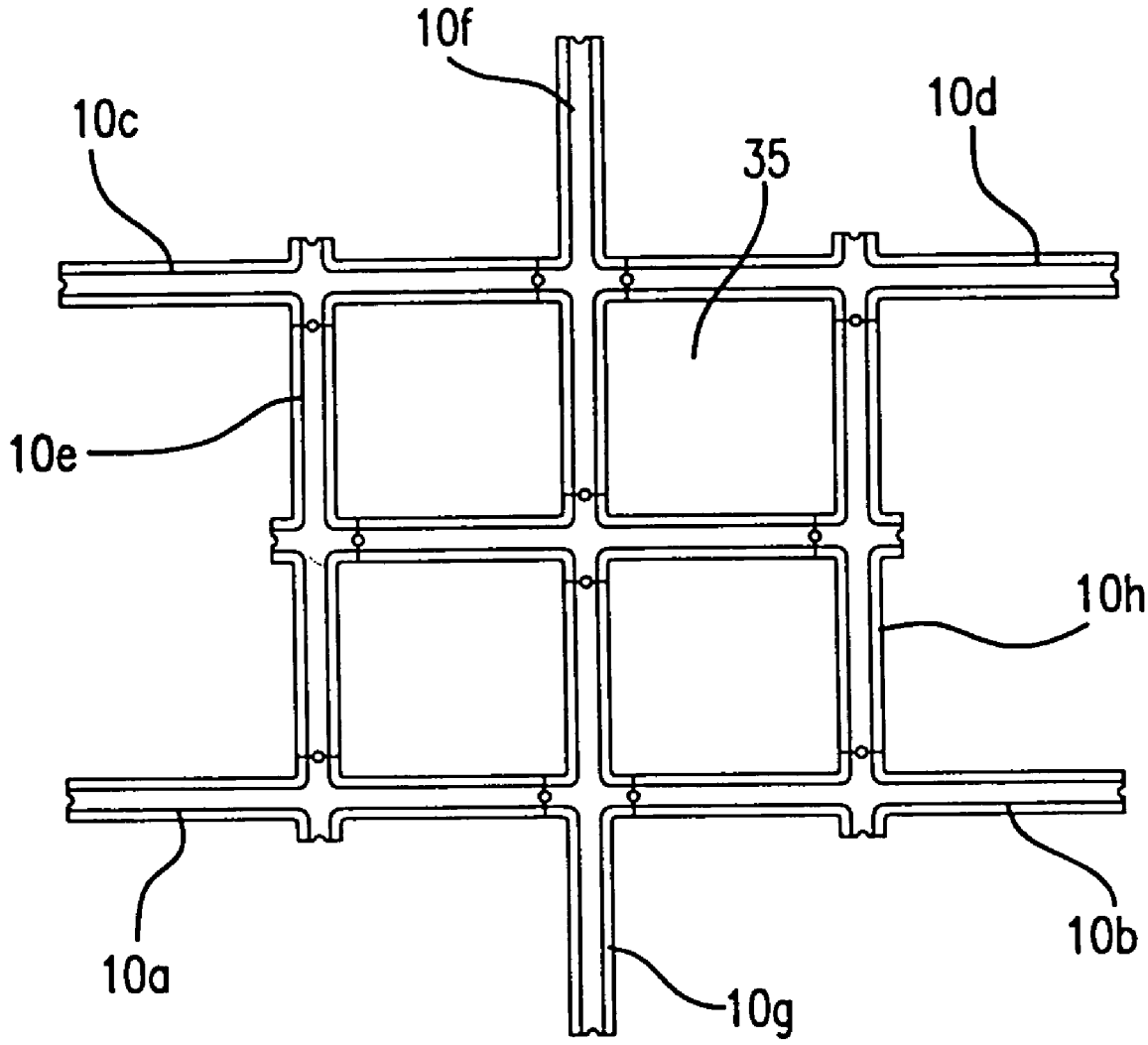
FIG. 7 is a top plan view of the erosion control matrix according to FIG. 6.

Referring again to FIG. 2, second end walls 32 at opposite ends of the cross-beam portion 12 similarly each include a second channel 33, which extends from the second wall top face 27 to the second base bottom face. These second end walls 32 are substantially perpendicularly oriented to the first end walls 17 of the elongated beam portion 11. In use, the second channels 33 also accommodate attachment pins. As shown in FIGS. 4 and 5, pairs of spaced apart, similarly sized end loops 21*c*, 21*d* project from the second end walls 32 into the second channels 33. Most preferably, the second channels 33 are generally semi-circular in shape, the end loops 21*c*, 21*d* are generally circular in shape, and the radii of the second channels 33 are approximately equal to the outer radii of the end loops 21*c*, 21*d*. The pairs of end loops 21*c*, 21*d* are vertically displaced from the pairs of end loops 21*a*, 21*b* in order to facilitate perpendicular connection of erosion control devices 10, as shown in FIGS. 5, 6, and 7. The end loops 21*a–d* are most preferably heavy duty, galvanized eye bolts or U-rings. An alternate embodiment, though, does not include first or second channels, as the erosion control devices need not about one another to be effective.

Rebar 36 extends longitudinally through both the elongated beam portion 11 and the cross-beam portion 12, where the erosion control device is made of a concrete-type material. The end loops 21*a–d* are mounted on opposite ends of the rebar 36 by any suitable means, such as by welding. Alternatively, only one end loop 21*a–d* is employed instead of a pair of end loops. Other suitable means of reinforcement may be employed in place of rebar.

Figure 8:
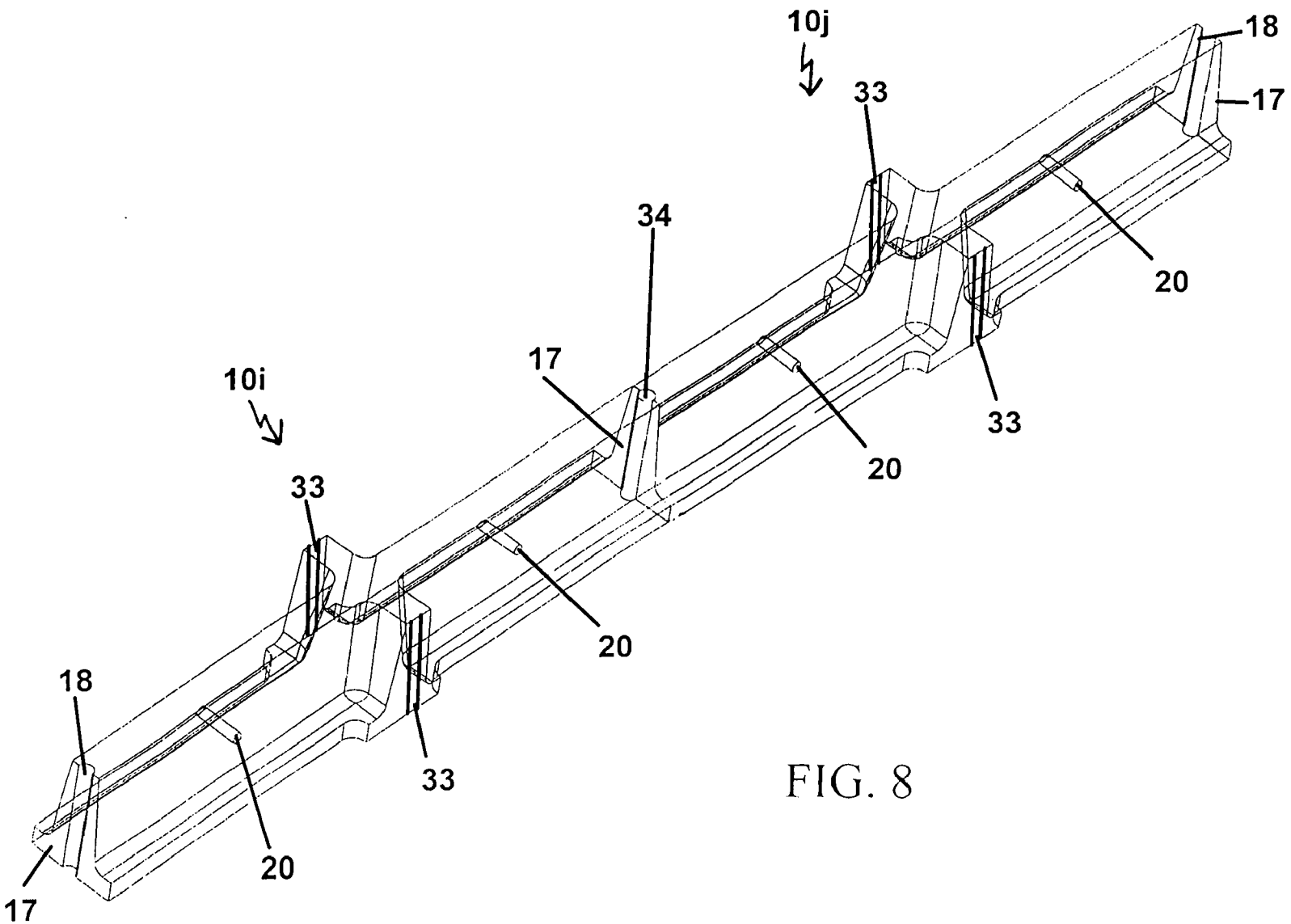
FIG. 8 is an isometric view of two erosion control devices according to the present invention, shown connected end to end.
Figure 9:
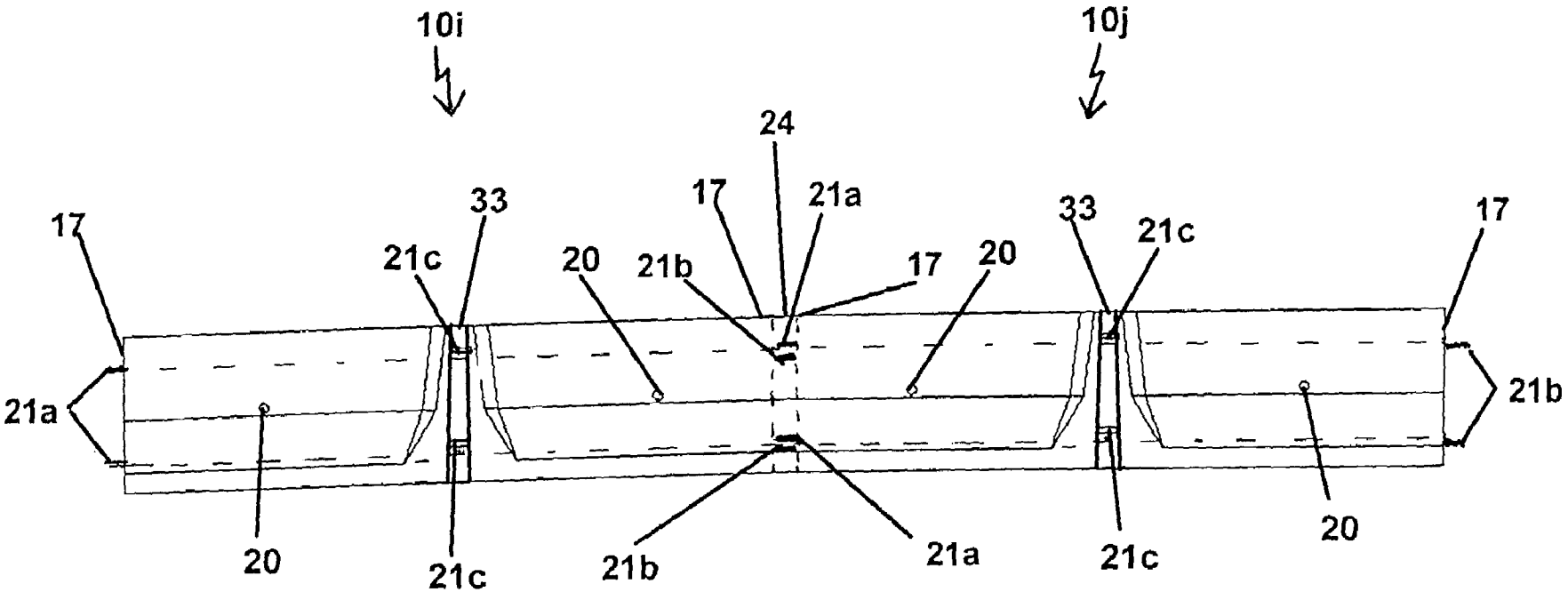
FIG. 9 is a side elevational view of two erosion control devices according to FIG. 8, shown connected end to end.

FIGS. 8 and 9 illustrate a first erosion control device 10*i* attached end to end to a second, identical erosion control device 10*j* with their longitudinal axes aligned. This linear formation can be used, for example, on the perimeter of an area to be protected, or as a series of relatively parallel underwater groins (sand-trapping structures built generally perpendicular to a beach). To connect two erosion control devices 10*i*, 10*j* end to end, a user brings a first end wall 17 of the first erosion control device 10*i*, which end wall comprises end loop 21*a* or 21*b*, into contact and alignment with a first end wall 17 of the second erosion control device 10*j*, which end wall comprises corresponding end loop 21*a* or 21*b*.

As seen in FIG. 9, the right end wall 17 of the first erosion control device 10*a* is in contact with the left end wall 17 of the second erosion control device 10*b*, with end loop 21*b* of the first erosion control device 10*a* corresponding to end loop 21*a* of the second erosion control device 10*b*. Consequently, the end loops 21*b* of the erosion control device 10*a* project into the first channel 18 of the second erosion control device 10*b*, and the end loops 21*a* of the second erosion control device 10*b* project into the first channel 18 of the first erosion control device 10*a*. The end loops 21*a* are then vertically displaced from the end loops 21*b*, but they are horizontally aligned. To complete the end to end connection, the user inserts an attachment pin 34 into a pin hole 24 formed by the adjacent, semi-circular first channels 18. Of course, it is appreciated that the erosion control devices 10*a*, 10*b* may each be rotated 180 degrees so that the left end wall 17 of the first erosion control device 10*a* may contact the right end wall 17 of the second erosion control device 10*b*, with end loops 21*a* of the first erosion control device 10*a* corresponding to end loops 21*b* of the second erosion control device 10*b*.

As shown in FIGS. 6 and 7, a number of erosion control devices 10*a–h* are interconnected end to end and side by side in an erosion control matrix 40. The erosion control devices 10*a–h* are substantially perpendicularly attached, and some are parallel to one another. The first erosion control device 10*a* is substantially perpendicularly connected to fifth and seventh erosion control devices 10*e* and 10*g*, a fourth erosion control device 10*d* is substantially perpendicularly connected to sixth and eighth erosion control devices 10*f* and 10*h*, and so on. To perpendicularly attach two erosion control devices, using the fourth and sixth erosion control devices 10*d*, 10*f* as an example, the user brings a first end wall 17 of the fourth erosion control device 10*d*, which comprises end loop 21*a* or 21*b*, into contact and alignment with a second end wall 32 of the sixth erosion control device 10*f*, which comprises corresponding end loop 21*c* or 21*d*. Consequently, the end loops 21*a* or 21*b* of the fourth erosion control device 10*d* project into the second channel 33 of the sixth erosion control device 10*f*, and the end loops 21*c* or 21*d* of the sixth erosion control device 10*f* project into the first channel 18 of the fourth erosion control device 10*d*. The end loops 21*a* or 21*b* are then vertically displaced from the end loops 21*c* or 21*d*, but they are horizontally aligned. To complete the substantially perpendicular connection, the user inserts an attachment pin 34 into a pin hole 24 (also see FIGS. 8 and 9) formed by the adjacent, semi-circular first and second channels 18, 33.

Thus, the erosion control devices 10 are attachable end to end, or side by side, or end to side perpendicularly to one another, and may be oriented in a variety of patterns. The erosion control devices 10 may even form a matrix 40. The matrix 40 may be further reinforced by cables or chains extending through the cross apertures 20 in the elongated beam portion 11 and between the erosion control devices 10.

The channels 18, 33 are preferably shaped alike, so that one end of the elongated beam portion 11 of a first erosion control device 10*a* is detachably connected (perpendicularly) to an end wall of the cross beam portion 12 of the second erosion control device 10*b*. An attachment pin 34 is thus preferably insertable in any set of two channels 18, 33, the channels forming a pin hole 24 for closely accommodating the attachment pin 34. Optionally, an end wall fo an elongated beam portion 11 of a third erosion control device 10*c* is detachably connected to an opposite end wall of the cross beam portion 12 of the second erosion control device 10*b*, forming a large cross-shaped matrix (see FIGS. 6 and 7. Alternatively, an end wall of a cross beam portion of a third erosion control device 10*c* is connected to the opposite end wall of the elongated beam portion 11 of the first erosion control device 10*a*, forming a large I-shaped matrix. Any other suitable mechanism for attachment may be used in place of attachment pins, such as bolts, anchors, chains, or cables.

According to the preferred embodiment of the erosion control device 10, the cross beam portion 12 resembles the elongated beam portion 11, except that the length of the cross-beam portion 12 is less than about a third of the length of the elongated beam portion 11. In the preferred embodiment, the side walls 16 curve into the second side walls 28, the base top face 31, and the second base top face 30, which creates radii of curvature R1, R2, and R3, respectively. The base side walls 19 also curvedly merge into the second base side walls 29, creating radii of curvature R4. The radii of curvature R1 are indicated in FIGS. 2 and 3, the radii of curvature R2 are shown in FIG. 2, the radii of curvature R3 are depicted in FIG. 3, and the radii of curvature R4 are seen in FIGS. 2 and 3. This curvature is advantageous in that it reduces stress on concrete devices 10 in contrast with sharp, angled concrete edges.

The erosion control devices 10 herein are dual purpose. First, they are used for preventing and/or slowing land and beach erosion. The erosion control devices 10 are particularly useful in restoring beach and dune areas lost from natural erosive forces, such as tides, waves, storms, and hurricanes and also erosion caused by human activities (e.g., pedestrian and vehicular traffic, heavy use of beach and dune areas, and overuse of beach and dune areas). Consequently, the erosion control devices 10 provide protection for coastal structures (e.g., homes, breakwaters, sea walls, and channels) from damage due to beach erosion, particularly during tropical storms and hurricanes. Secondly, the erosion control devices 10 are utilized to rebuild land and beach areas damaged by erosion.

To use the erosion control devices 10, the user lays a first erosion control device 10*a* on the sand or earth, and then connects a second erosion control device 10*b* end to end or side by side with the first erosion control device. The user then connects a third erosion control device 10*c* end to end or side by side with the first or second erosion control device 10*a* or 10*b*, and so forth. The same process may be undertaken anywhere erosion exists or may occur, such as on a hillside, embankment, dike, or highway shoulder, at the bottom of a ditch, under a roadbed as it is being built, etc.

The erosion control matrix 40 is left on the beach or ground surface. It is preferably buried under a few inches or more of sand (e.g., in a beach re-nourishment project) or earth. If desired, the matrix may be placed on large pieces of fabric for holding the earth in areas subject to heavy erosion. When it is used on a beach, it is preferably placed on top of the existing sand at the dune line at low tide level, and then a few inches of new sand is dumped on top. Like a suit of armor, the matrix protects the beach.

The spaces 35 (usually squares; see FIG. 7) of earth between the erosion control devices 10 are convenient locations for planting trees, shrubs, native grasses, etc. The erosion control devices serve to protect the growing plants, which beautify the landscape. Also, the roots of the plants also help to prevent erosion.

Furthermore, the erosion devices 10 may be used in highway construction. Exemplary applications in highway construction include: stabilization of soils under roadbeds, erosion control of embankments, ditch linings, highway shoulders, and highway undersurfaces.

Matrices 40 of larger size erosion control devices according to the present invention (without cables 41) would help ameliorate the decline of sea turtles, in that the devices help prevent and remedy erosion problems, and in that the spaces 35 in the matrices 40 (see FIG. 7) provide a nesting site for a nesting sea turtle with the surrounding devices providing protection for the turtle. For this use, the erosion control matrix 40 should be buried just under the surface of the beach.

The erosion control devices 10 are preferably constructed entirely from concrete. Concrete is desirable because it is not subject to corrosion or biodegradation. Concrete is also a preferred construction material because the erosion control devices 10 are easily and relatively inexpensively manufactured by a concrete molding process. To construct concrete erosion control devices 10, the user simply inserts prefabricated rebar 36 into a pre-fabricated form of the erosion control device 10. Next, the user pours concrete into the form and allows it to harden around the rebar 36 and assume the shape of the form. Upon removal of the concrete containing rebar from the form, the erosion control device 10 is ready for use. Other suitable materials of construction include plastics, metals, composites, and fiberglass.

The erosion control devices 10 range in size, depending on the intended use. Relatively small devices 10 about four to five feet in length are used, for example, on embankments, while relatively large devices 10 about 12 feet in length and weighing several tons can be used off-shore. In a preferred embodiment of the erosion control device 10 for remedying beach erosion, the distance between the side walls 19 is approximately 12 feet, and the distance between the base bottom face (not shown) and the wall top face 15 is approximately ⅙ the distance between the side walls 19. In an alternate embodiment for preventing and controlling ground erosion, the distance between the side walls 19 is approximately three feet, the distance between the base bottom face (not shown) and the wall top face 15 is slightly less than that, and the distance between the second end walls 32 is approximately three feet.

Preferably, the cross apertures 20 are between about one and two, more preferably about 1.5, inches in diameter (inner diameter) and about one foot below the wall top face 15. The end loops are preferably between about one and two, more preferably about 1.5, inches in diameter (inner diameter).

Figure 10:
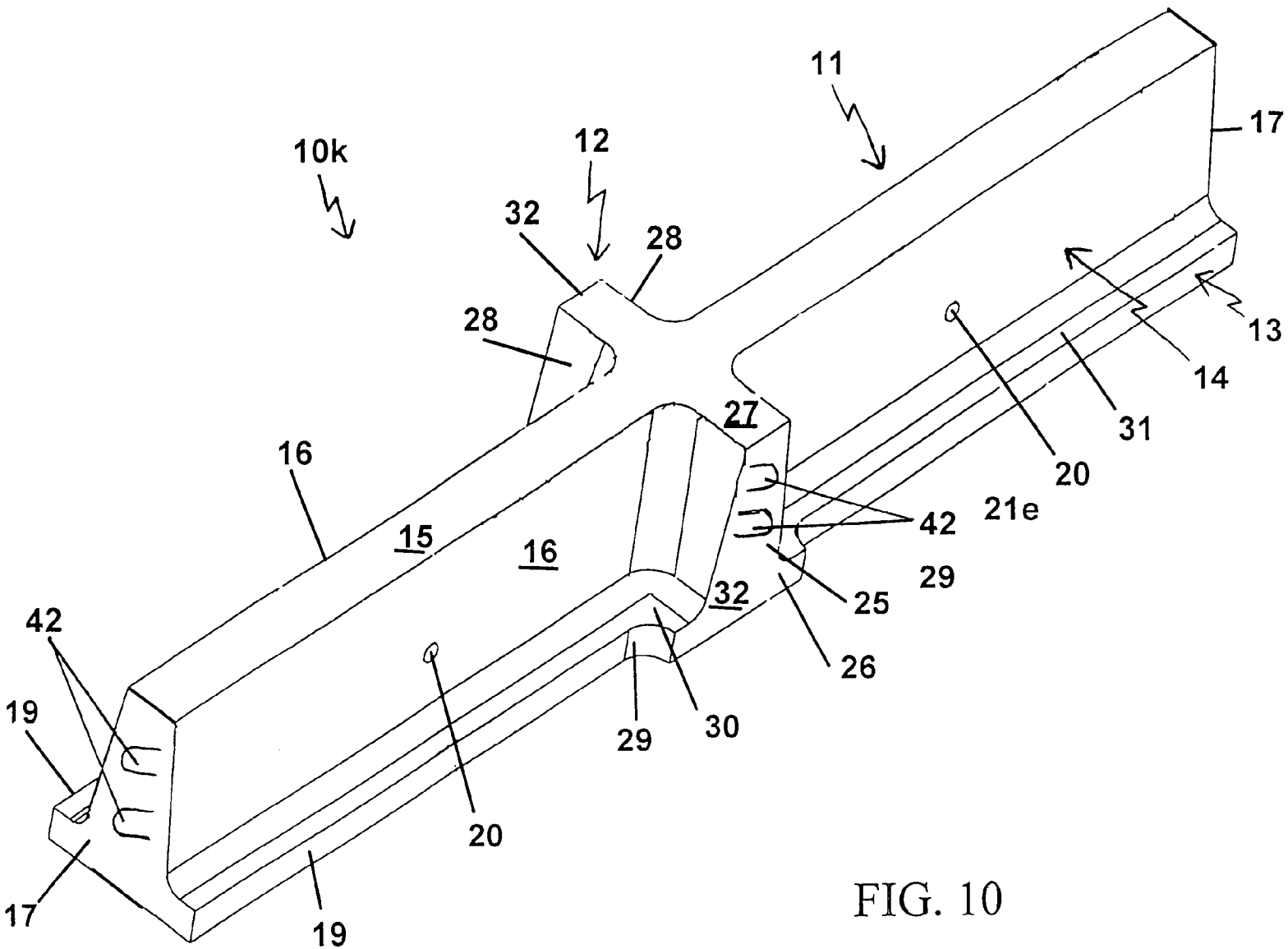
FIG. 10 is a perspective view of an erosion control device according to the present invention.

Turning to FIG. 10, an erosion control device 10*k* comprises an elongated beam portion 11 and a cross-beam portion 12 that extends transverse to the elongated beam portion, with the length of the cross-beam portion 12 being less than half the length of the elongated beam portion 11. The elongated beam portion 11 is comprised of a first wall 14 supported on a first base 13 (see FIG. 1). The first wall 14 has a generally planar wall top face 15 opposite the first base 13 and substantially perpendicular to two opposed, mirror image, generally planar wall side faces 16. The first wall 14 is on the first base 13, which also comprises a generally planar base top face 21 and a generally planar base bottom face. The base top face 31 and the base bottom face are spaced apart by the base side faces 19 and are substantially parallel to each other. The generally rectangular-shaped first base 13 is wider than the first wall 14 so as to impart stability to the erosion control device 10*k*. However, this embodiment includes a pair of rotatable connectors 42, rather than first and second channels and end loops. The rotatable connectors 42 project from the first end walls and/or the second end walls (middle section) of each erosion control device 10*k*.

Figure 11:
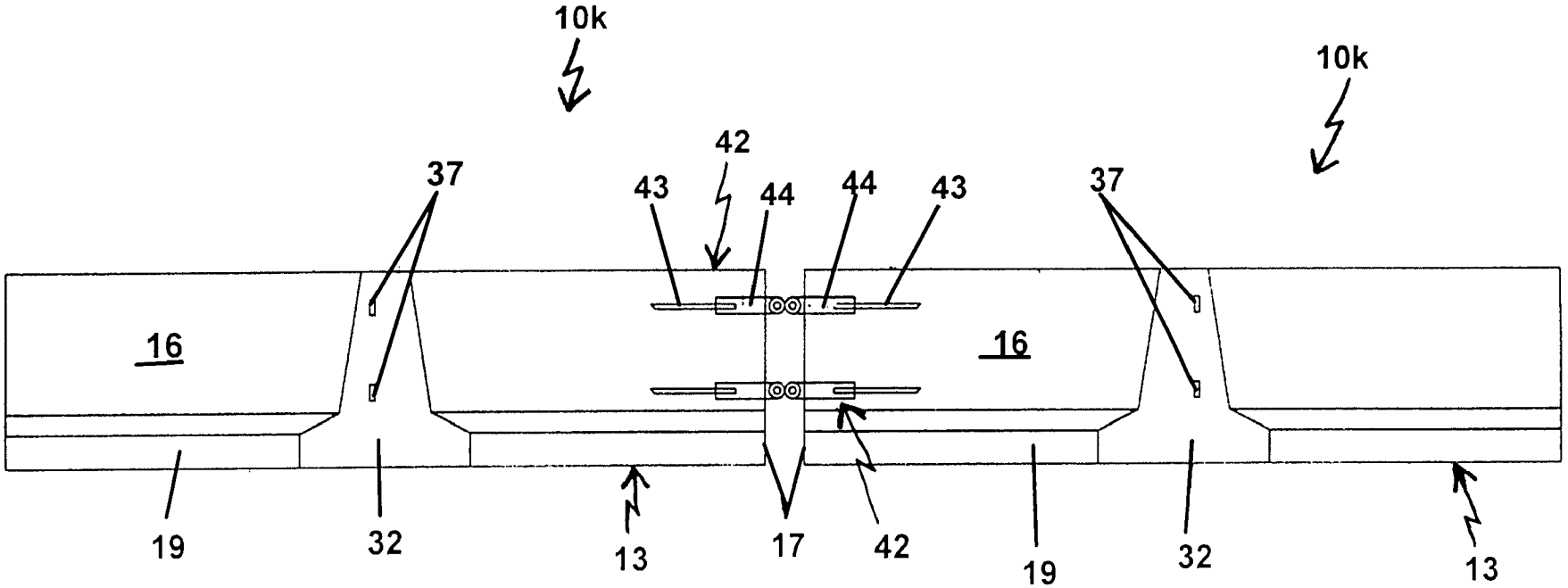
FIG. 11 is a front elevational view of two erosion control devices according to FIG. 10, laid end to end.
Figure 12:
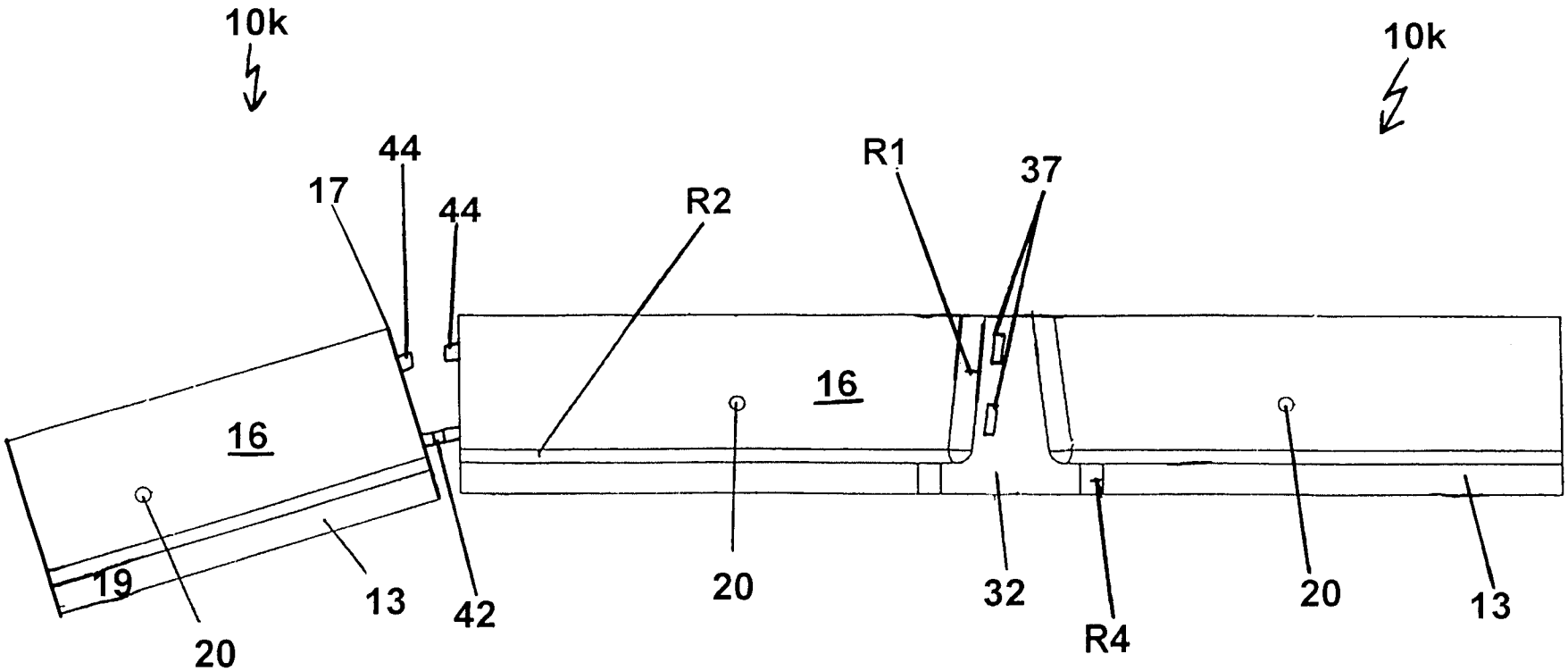
FIG. 12 is a front elevational view of two erosion control devices according to FIG. 10, one being on a slope.
Figure 13:
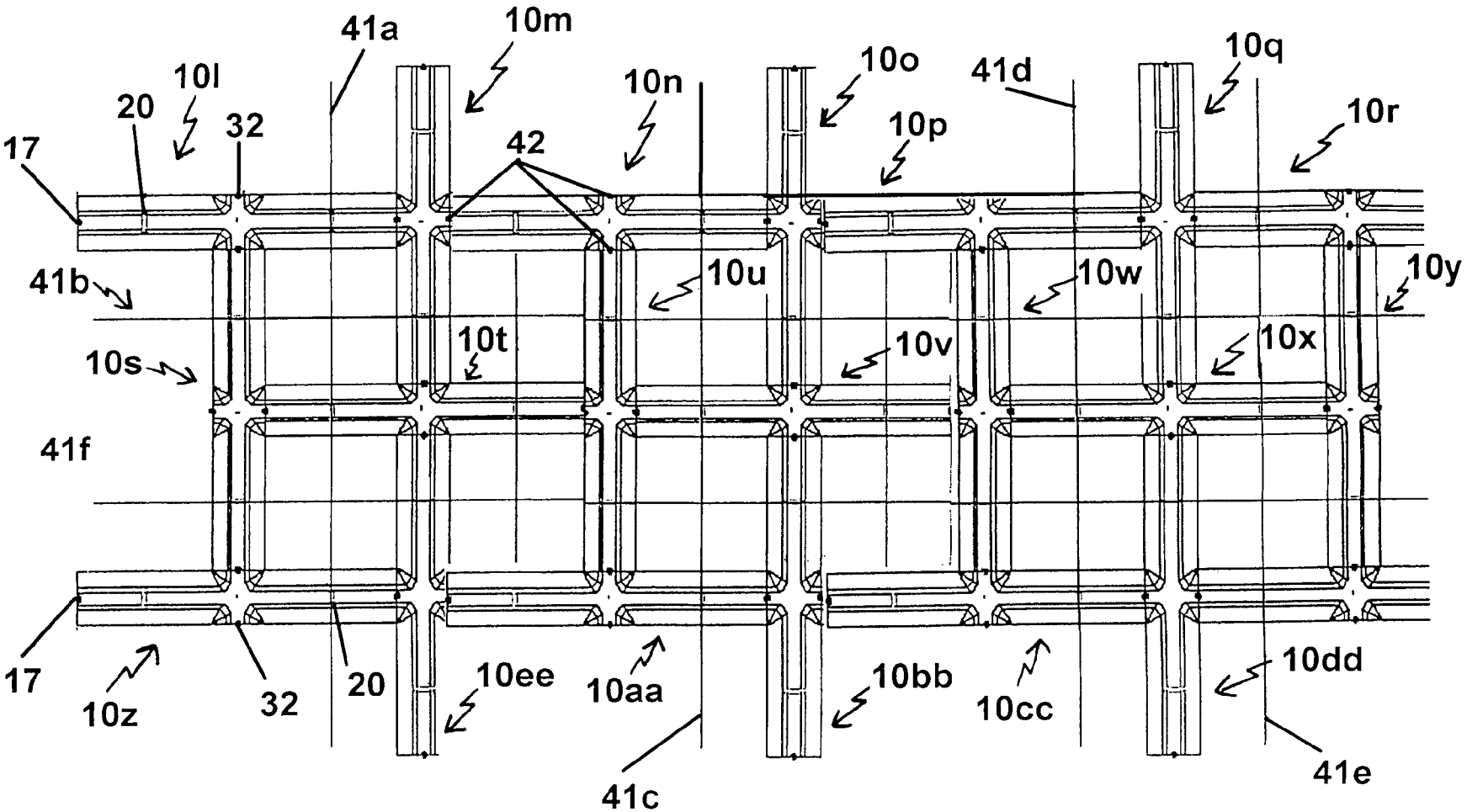
FIG. 13 is a top plan view of an erosion control matrix according to the present invention.
Figure 14:
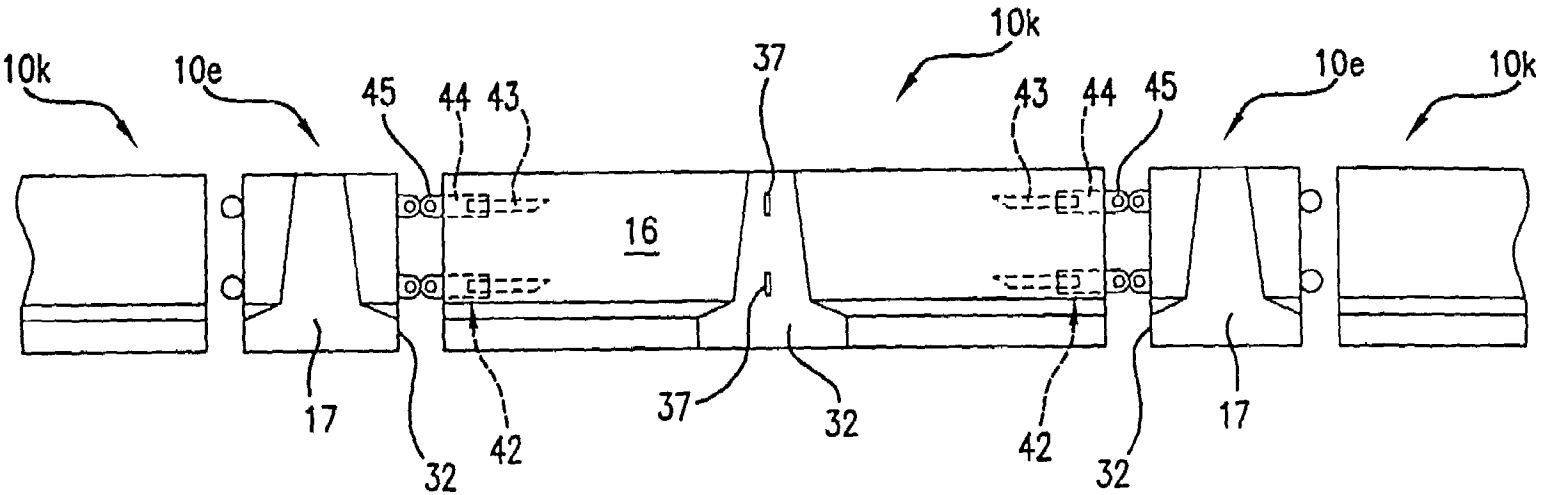
FIG. 14 is a front elevational view of a number of erosion control devices according to the present invention.
Figure 15:
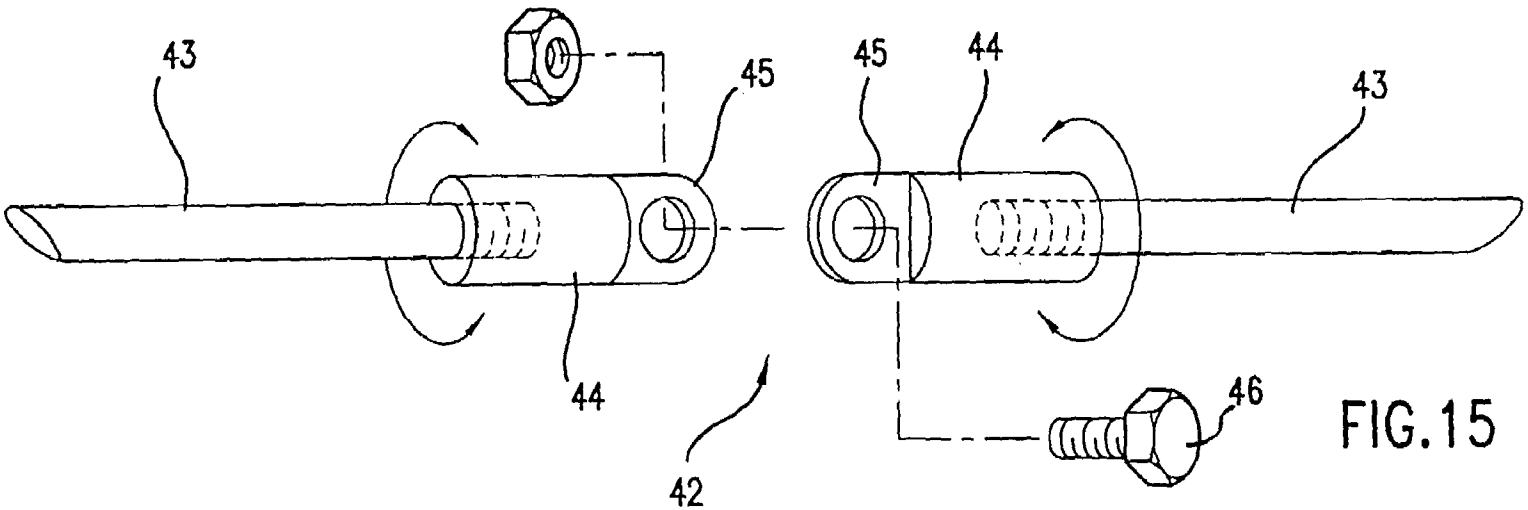
FIG. 15 is a perspective view of a rotatable connector of an erosion control device according to the present invention.

As shown in FIGS. 10 through 15, the universal rotatable connectors 42 each comprise a connector tail 43 embedded in the erosion control device, and a cylindrical-shaped connector head 44 with a hole extending along a rear portion of the longitudinal axis of the head. The connector tail 43 has a smaller diameter than the diameter of the connector head 44. As shown in FIGS. 11 and 15, a front, threaded end of the connector tail 43 is connectable to the correspondingly threaded hole in the rear end of the connector head 44. For example, a twist tie, or a screw 46 and nut as shown in FIG. 15 can be inserted through the holes in the loops 45 of two opposite connectors 42. The opposite end of the connector tail 43 is preferably connected to rebar 36 embedded in the erosion control device 10. This opposite end of the connector tail 43 is preferably pointed (see FIG. 15) in order to facilitate connection in the erosion control device. The connector head 44 is rotatable on the connector tail 43. At the opposite end of the connector head 44 is a loop 45 or other type of connector that allows two head ends to be connected to one another, as shown in FIGS. 12 and 14. The connectors 42 allow flexibility in the ways the erosion control devices 10 can be connected to one another. They also allow connection of two erosion control devices 10*k* at any angle.

With the connectors 42, one erosion control device need not be on the same plane as the neighboring erosion control device. For example, an erosion control device 10*k* on a sloped side of an embankment or sand dune can be connected to a second device 10*k* lying relatively horizontal on top of the embankment, as shown in FIG. 12. It is only necessary to connect the bottommost rotatable connectors 42 to one another. If desired, a third erosion control device 10*k* on the down slope of the embankment can similarly be connected on the other end of the second device. This positioning on a steep slope can also be done with the loops and pins embodiment described hereinabove. Other mechanisms for connecting two or more erosion devices to one another can be employed in place of rotatable connectors, such as a metal plate with a hole in it, or an I-bolt welded to the rebar 36.

In the second erosion control matrix 50 depicted in FIG. 13, a number of erosion control devices 10 *l–dd* are fastened together end to middle. For example, device 10*u* is connected to device 10*n* and device 10*aa* on its end walls 17, and to device 10*t* and device 10*v* on its middle walls 25. One or more rotatable connectors 42, or another mechanism of connection, extending from the first end wall 17 of one erosion control device 10*u*, are brought into contact and alignment with a corresponding rotatable connector 42 on the second end wall 32 of another erosion control device 10*t*. The rotatable connectors 42 are connected to one another, as by a pin or bolt through a hole in the loop 45. These connections are preferably reversible, so if the set-up is not working for some reason, the devices 10 can be disconnected, moved, and then reconnected.

To assemble and use the matrix 50 after trucking a number of erosion control devices 10 to the site where the matrix will be placed, a user lays out the desired number of erosion control devices 10 in the desired pattern and strings them together by passing cables 41 through the two cross-apertures 20 in each device 10 (see FIG. 13). The cables 41 help to prevent the matrix 50 from coming apart in a big storm surge or hurricane, for example. The individual erosion control devices 10 can then be connected to one another by the rotatable connectors 42 or other suitable mechanism for connection. The erosion control matrix 50 can be assembled directly on the site, or it can be assembled nearby, then picked up (by a crane, for example), and dropped onto the site.

A matrix may include relatively small erosion control devices or relatively large devices, depending on the application, though a single matrix preferably includes a number of same-sized erosion control devices. A matrix of large erosion control devices 40, 50 weighing several tons each can be used off-shore, and may be used to protect one side of a barrier island from erosion, for example.

Referring to FIGS. 14 and 15, the connector head 44 of a rotatable connector 42 on an end wall 17 of a first erosion control device 10*k* can be connected to a connector head 44 of a corresponding rotatable connector 42 on a middle wall 32 of a device 101 that is laid out perpendicular to the first device 10*k*. The same is true on an opposite end of the erosion control device 10*k*.

From the foregoing it can be realized that the described device of the present invention may be easily and conveniently utilized as an erosion control device and matrix for remedying ground and beach erosion, rebuilding land areas lost to erosion, and various highway applications. It is to be understood that any dimensions given herein are illustrative, and are not meant to be limiting.

While preferred embodiments of the invention have been described using specific terms, this description is for illustrative purposes only. It will be apparent to those of ordinary skill in the art that various modifications, substitutions, omissions, and changes may be made without departing from the spirit or scope of the invention, and that such are intended to be within the scope of the present invention as defined by the following claims. It is intended that the doctrine of equivalents be relied upon to determine the fair scope of these claims in connection with any other person's product which fall outside the literal wording of these claims, but which in reality do not materially depart from this invention. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. An erosion control device for stabilizing soils and remedying beach and land erosion, the device comprising:

(a) an elongated beam portion comprising a first wall and a first base;

(b) a cross-beam portion having a length that is less than half the length of the elongated beam portion, the cross-beam portion being integral with the erosion control device and comprising a second wall and a second base; and (c) a mechanism for connecting the erosion control device to a second erosion control device; and further comprising two first end walls at opposite ends of the elongated beam portion, each first end wall comprising a first channel; a plurality of similarly sized end loops projecting from the end walls of the cross beam portion; wherein the cross-beam portion extends transversely through the elongated beam portion at about a mid-point of the elongated beam portion; and wherein the elongated beam portion does not taper from its center towards either of the first end walls.

2. The erosion control device according to claim 1, wherein a radius of the first channel of each first end wall is approximately equal to an outer radius of each of the plurality of end loops.

3. The erosion control device according to claim 1, wherein the erosion control device is substantially comprised of a concrete material, with at least one rebar extending through the erosion control device, the end loops being mounted on opposite ends of the rebar.

4. The erosion control device according to claim 3, wherein the end loops are I-bolts or U-rings.

5. An erosion control matrix comprising at least two erosion control devices, each erosion control device comprising:

(a) an elongated beam portion comprising a first wall and a first base; and (b) an integral cross-beam portion having a length that is less than half the length of the elongated beam portion, the cross-beam portion extending transversely through the elongated beam portion at about a mid-point of the elongated beam portion, the cross-beam portion comprising a second wall and a second base;

wherein the cross beam portion and the elongated beam portion each comprise opposite end walls, each end wall comprising a semi-circular channel; at least one end loop extending from the end wall of the cross beam portion across the channel; wherein the elongated beam portion does not taper from its center towards either of its end walls; and wherein the at least two erosion control devices are detachably connectable to one another side by side by an attachment device inserted through the at least one loop of each of the erosion control devices.

6. The erosion control matrix according to claim 5, further comprising cables extendable through at least two cross apertures in the elongated beam portions of the two erosion control devices, and between the erosion control devices.

7. An erosion control matrix comprising at least two erosion control devices, each erosion control device comprising:

(a) an elongated beam portion comprising a first wall and first base; and (b) an integral cross-beam portion having a length that is less than half the length of the elongated beam portion, the cross-beam portion extending transversely through the elongated beam portion at about a mid-point of the elongated beam portion, the cross-beam portion comprising a second wall and a second base;

wherein the cross beam portion and the elongated beam portion each comprise opposite end walls, the elongated beam portion does not taper from it center towards either of its end walls; and the at least two erosion control devices are detachably connectable to one another end to end, side by side, and end to side; and wherein the at least two erosion control devices are connected by at least two complementary rotatable connectors, a portion of each roatable connector projecting from at least one of the end walls of each of the at least two erosion control devices.

8. The erosion control matrix according to claim 7, wherein one end of the elongated beam portion of a first one of the at least two erosion control devices is detachably connected to one end of the cross beam portion of a second one of the at least two erosion control devices.

9. The erosion control matrix according to claim 8, wherein the erosion control matrix comprises three of the least two erosion control devices; and wherein an end wall of an elongated beam portion of a third one of the erosion control devices is detachably connected to an opposite end wall of the cross beam portion of the second erosion control device, the erosion control devices forming a cross-shaped matrix.

10. The erosion matrix control according to claim 8, wherein the erosion control matrix comprises three of the at least two erosion control devices; and wherein an end wall of a cross beam portion of a third one of the erosion control devices is connected to the opposite end wall of the elongated beam portion of the first erosion control device.

* * * * *